US009957849B2

(12) United States Patent
Betz

(10) Patent No.: US 9,957,849 B2
(45) Date of Patent: May 1, 2018

(54) CAMSHAFT ADJUSTER

(71) Applicant: Schaeffler Technologies AG & Co. KG, Herzogenaurach (DE)

(72) Inventor: Christoph Betz, Hausen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 64 days.

(21) Appl. No.: 14/784,363

(22) PCT Filed: Feb. 11, 2014

(86) PCT No.: PCT/DE2014/200050

§ 371 (c)(1),
(2) Date: Oct. 14, 2015

(87) PCT Pub. No.: WO2014/169907

PCT Pub. Date: Oct. 23, 2014

(65) Prior Publication Data

US 2016/0115828 A1 Apr. 28, 2016

(30) Foreign Application Priority Data

Apr. 15, 2013 (DE) ..... 10 2013 206 672

(51) Int. Cl.
*F01L 1/34* (2006.01)
*F01L 1/344* (2006.01)
*F01L 1/047* (2006.01)

(52) U.S. Cl.
CPC ..... *F01L 1/34* (2013.01); *F01L 1/047* (2013.01); *F01L 1/344* (2013.01); *F01L 2001/34483* (2013.01)

(58) Field of Classification Search
CPC ..... F01L 1/3442; F01L 2001/34483; F01L 1/344
USPC ..... 123/90.15, 90.17
See application file for complete search history.

(56) References Cited

U.S. PATENT DOCUMENTS 5,031,585 A 7/1991 Muir et al.
8,166,936 B2 * 5/2012 Fujiyoshi ..... F01L 1/3442 123/90.15
8,863,707 B2 * 10/2014 Weiber ..... F01L 1/3442 123/90.15
8,925,507 B2 1/2015 Weber
(Continued)

FOREIGN PATENT DOCUMENTS

DE 102006002993 8/2007
DE 102008056796 5/2010
(Continued)

*Primary Examiner* — Ching Chang
(74) *Attorney, Agent, or Firm* — Davidson, Davidson & Kappel, LLC

(57) ABSTRACT

A camshaft adjuster having a drive element, an output element and a spring, wherein the drive element and the output element can rotate relative to each other, wherein the spring is secured by a spring bearing of the drive element and a spring bearing of the output element, wherein the spring supports the relative rotation between the drive element and the output element, wherein the spring bearing has a radius that is larger than the radius of the spring and, as a result of this ratio of the radii, a two-line contact between the spring and the spring bearing is formed.

16 Claims, 1 Drawing Sheet

(56) References Cited

U.S. PATENT DOCUMENTS

| | | | | |
|---|---|---|---|---|
| 8,967,107 | B2 * | 3/2015 | Boese | F01L 1/344 123/90.15 |
| 2009/0188456 | A1 | 7/2009 | Dupuis et al. | |
| 2010/0064996 | A1 | 3/2010 | Lichti et al. | |
| 2010/0116233 | A1 | 5/2010 | Weisser et al. | |
| 2010/0154732 | A1 | 6/2010 | Bayrakdar | |
| 2011/0030632 | A1 | 2/2011 | Pascal | |
| 2013/0324269 | A1 | 12/2013 | Janitschek et al. | |
| 2013/0327288 | A1 | 12/2013 | Boese | |

FOREIGN PATENT DOCUMENTS

| | | |
|---|---|---|
| DE | 102010051052 | 5/2012 |
| DE | 102010060620 | 5/2012 |
| DE | 102011003769 | 8/2012 |
| DE | 102011088295 | 6/2013 |
| EP | 2184450 | 5/2010 |

* cited by examiner

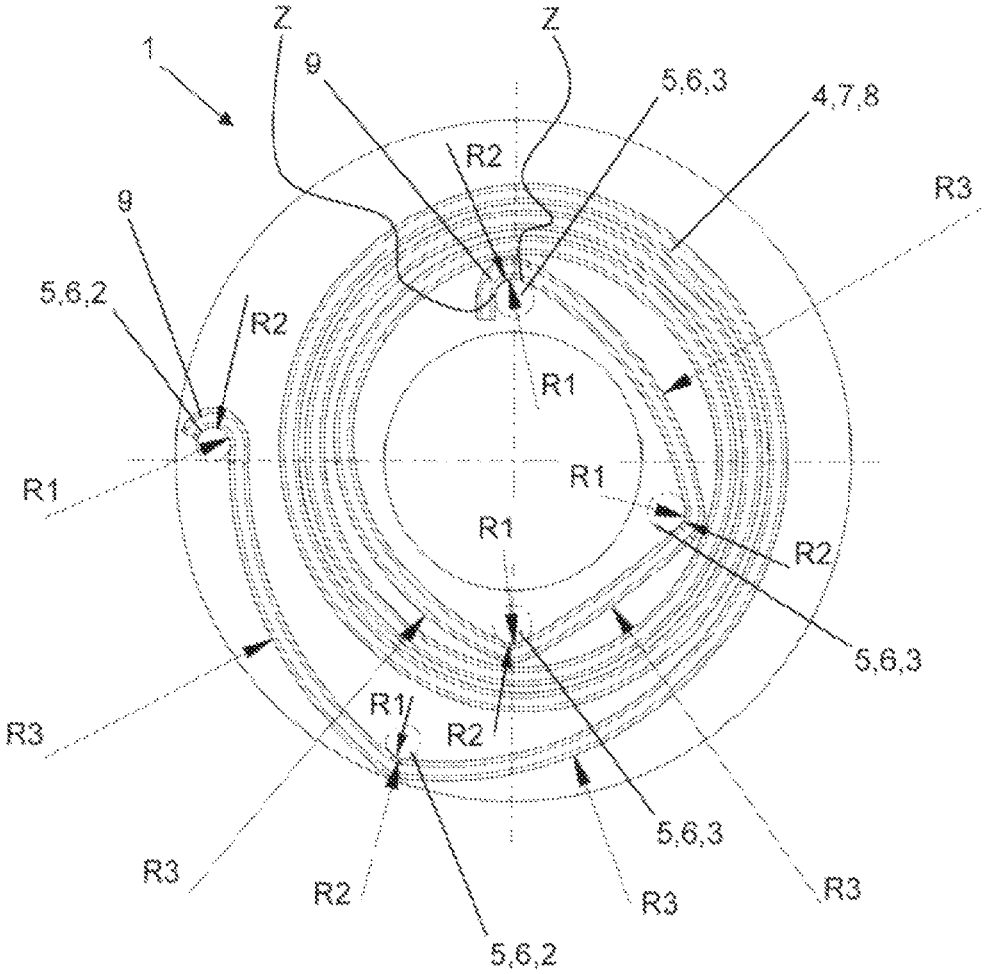
1
Z
Z
9
5,6,3
4,7,8
R2
R3
9
5,6,2
R2
R1
R1
R1
R1
R2
5,6,3
R3
R1
R2
5,6,3
R3
R2
R3
R3
5,6,2

CAMSHAFT ADJUSTER

The present invention relates to a camshaft adjuster.

BACKGROUND

Camshaft adjusters are used in internal combustion engines to vary the control times of the combustion chamber valves to be able to vary the phase relation between the crankshaft and the camshaft in a defined angle range between a maximum advance position and a maximum retard position. Adjusting the control times to the instantaneous load and rotational speed reduces consumption and emissions. For this purpose, camshaft adjusters are integrated into a drive train, via which a torque is transferred from the crankshaft to the camshaft. This drive train may be designed, for example, as a belt, chain or gear drive.

In a hydraulic camshaft adjuster, the output element and the drive element form one or multiple pair(s) of counteracting pressure chambers to which a hydraulic medium is applied. The drive element and the output element are coaxially situated. A relative movement between the drive element and the output element is created by filling and emptying individual pressure chambers. The rotatively acting spring between the drive element and the output element pushes the drive element toward the output element in an advantageous direction. This advantageous direction may be in the same direction or in the opposite direction of the direction of rotation.

One design of the hydraulic camshaft adjuster is the vane adjuster. The vane adjuster includes a stator, a rotor and a drive wheel, which has an external toothing. The rotor as the output element is usually designed to be rotatably fixedly connectable to the camshaft. The drive element includes the stator and the drive wheel. The stator and the drive wheel are rotatably fixedly connected to each other or, alternatively, they are designed to form a single piece with each other. The rotor is situated coaxially with respect to the stator and inside the stator. Together with their radially extending vanes, the rotor and the stator form oppositely acting oil chambers, to which oil pressure may be applied and which facilitate a relative rotation between the stator and the rotor. The vanes are either designed to form a single piece with the rotor or the stator or are situated as "plugged-in vanes" in grooves of the rotor or stator provided for this purpose. The vane adjusters furthermore include various sealing covers. The stator and the sealing covers are secured to each other with the aid of multiple screw connections.

Another design of the hydraulic camshaft adjuster is the axial piston adjuster. In this case, a shifting element, which creates a relative rotation between a drive element and an output element via inclined toothings, is axially shifted with the aid of oil pressure.

A further design of a camshaft adjuster is the electromechanical camshaft adjuster, which has a three-shaft gear set (for example, a planetary gear set). One of the shafts forms the drive element and a second shaft forms the output element. Rotation energy may be supplied to the system or removed from the system via the third shaft with the aid of an actuating device, for example an electric motor or a brake. A spring may be additionally situated, which supports or feeds back the relative rotation between the drive element and the output element.

DE 10 2006 002 993 A1 shows a camshaft adjuster, which includes a chain wheel, a rotor, a housing and a spring. The housing and the rotor form the working chambers for the relative rotation. The chain wheel is rotatably fixedly connected to the housing. The spring is situated outside the housing and is protected against external contamination by an additional spring cover connected to the chain wheel, so that it is largely protected against external effects which shorten the service life. The rotor includes a pin which penetrates the housing and which provides a support for an elastic foot of the spring.

SUMMARY OF THE INVENTION

It is an object of the present invention to provide a camshaft adjuster which increases the service life of the spring.

The present invention provides a camshaft adjuster which includes a drive element, an output element and a spring, the drive element and the output element being rotatable relative to each other, the spring being fixed by a spring bearing of the drive element and a spring bearing of the output element, the spring supporting the relative rotation between the drive element and the output element, in such a way that the spring bearing has a radius which is greater than a radius of the spring, and a two-line contact between the spring and the spring bearing is formed by this ratio of the radii.

This achieves the fact that the spring wire of the spring is better fixed on the particular spring bearing, due to the two-line contact, so that the relative movement between the spring and the particular spring bearing, and thus also the wear, is minimized. The service life of the spring and/or the spring bearing is/are significantly increased.

The spring wire wraps around the spring bearing, in that the spring wire forms a first line contact at a first contact point with the spring bearing, has the smaller radius than the radius of the spring bearing in the further course of the spring wire and finally forms the second line contact. The spring wire is thus advantageously better fixed on the spring bearing.

Due to the formation of the two-line contact described at the outset, the Hertzian contact stresses are minimized, whereby the service life on this spring bearing is increased, and the failure probability of the spring is minimized.

In one embodiment of the present invention, the spring includes a coil body, whose coils extend in the radial direction. A spring of this type advantageously requires very little installation space in the axial direction.

The coil body has a largely constant incline, while the ends of the spring deviate from this constant incline in the course of the spring wire.

In one advantageous embodiment, the spring bearing is designed as a pin. A pin as the spring bearing is advantageously very economical to manufacture. Multiple pins may be provided, which together fix and support the spring or one end of the spring. The end of the spring abuts the coil body, which essentially has the characteristics typical for a spring.

In one embodiment of the present invention, the spring bearing supports one end of the spring. The end of the spring is advantageously designed as a hook, which wraps around the spring bearing in the same manner described at the outset, and the two-line contact is provided by the formation of the ratio of the radii.

In one particularly preferred embodiment, the spring bearing supports the coil body of the spring. The vibration-induced oscillations in the coil body may advantageously be damped without negatively influencing the service life of the spring.

In one preferred embodiment, all spring bearings have the two-line contact which is formed by the ratio of the radii.

In another embodiment of the present invention, the spring bearing is provided with a wear-resistant coating. The service life of the spring and the spring bearing is further increased by the wear-resistant coating. Alternatively, the spring bearing may be subjected to a wear-reducing heat treatment.

In one embodiment of the present invention, the coil body of the spring has a larger radius between the spring bearings than the radius of at least one of the spring bearings for forming a two-line contact. This greater radius may also be infinitely large, whereby a straight piece between the spring bearings is formed by the coil body of the spring.

The formation of a two-line contact by the targeted ratio of the radii between the spring wire of the spring and the spring bearing increases the service life of the spring and the spring bearing and minimizes the friction due to vibrations.

BRIEF DESCRIPTION OF THE DRAWINGS

Exemplary embodiments of the present invention are illustrated in the FIGURES.

FIG. 1 shows a camshaft adjuster, which includes a spring according to the present invention and a spring bearing according to the present invention.

DETAILED DESCRIPTION

FIG. 1 shows a camshaft adjuster 1, which includes a spring 4 according to the present invention and a spring bearing 5 according to the present invention. The structure and functionality of camshaft adjuster 1 are known from the prior art, for which reason camshaft adjuster 1 is illustrated in a highly schematic manner herein.

The special features according to the present invention are discussed below. Spring 4 includes a coil body 7 which extends in the radial direction. Spring 4 is supported on three spring bearings 5 in the interior of coil body 7. Outside coil body 7, spring 4 is supported on two spring bearings 5. All spring bearings 5 are designed as pins or bolts; therefore, they each have a cylindrical outer lateral surface which contacts spring wire 8.

Inner end 9 of spring 4 is designed as a hook and wraps around a first pin 6 in the 12-o'clock position. Two additional pins 6, which support spring 4, are situated in an angle range of 90° to 180° from first pin 6, starting in the coil direction of spring 4. These three pins 6 described above are rotatably fixedly provided with output element 3 of camshaft adjuster 1. Spring 4 has a radius of curvature R3 between these pins 6; however, in the area of the contacting with pins 6, spring 4 has a radius of curvature R1, which is smaller than radius R2 of particular contacted pin 6. Radii R3 are multiple times larger than Radii R2 and R1. Due to the ratio of the radii between radii R1 and R2, a two-line contact Z is formed. For the sake of clarity, two-line contact Z is limited by way of example to one pin 6 in the illustration but may be transferred in the same manner to all pins 6. Spring wire 8 is situated at a distance from pin 6 between the two line contacts of two-line contact Z. The transition from radius R2 to radius R3 contacts the cylindrical outer lateral surface of pin 6 as the first line contact of two-line contact Z. The second line contact of two-line contact Z may also be formed by the transition of radius R2 to radius R3 with the cylindrical outer lateral surface of pin 6 or by a transition of radius R2 to a straight piece of spring wire 8 of spring 4 with the cylindrical outer lateral surface of pin 6.

Outer end 9 of spring 4 is designed as a hook and wraps around a fifth pin 6 in the 9-o'clock position. Another pin 6, which supports spring 4, is situated in an angle range of 0° to 90° from fifth pin 6, starting from this end and counter to the coil direction of spring 4. These two pins 6 described above are rotatably fixedly provided with drive element 2 of camshaft adjuster 1. Spring 4 has a radius R3 between these pins 6; however, in the area of the contacting with pins 6, spring 4 has a radius R1, which is smaller than radius R2 of particular contacted pin 6. Radii R3 are multiple times larger than Radii R2 and R1. Due to the ratio of the radii between radii R1 and R2, a two-line contact Z is formed. The transition from radius R2 to radius R3 contacts the cylindrical outer lateral surface of pin 6 as the first line contact of two-line contact Z. The second line contact of two-line contact Z may also be formed by the transition of radius R2 to radius R3 with the cylindrical outer lateral surface of pin 6 or by a transition of radius R2 to a straight piece of spring wire 8 of spring 4 with the cylindrical outer lateral surface of pin 6.

LIST OF REFERENCE NUMERALS

1) camshaft adjuster
2) drive element
3) output element
4) spring
5) spring bearing
6) pin
7) coil body
8) spring wire
9) (inner, outer) end of the spring
R1) radius (spring bearing)
R2) radius (spring)
R3) radius (spring)
Z) two-line contact

What is claimed is:

1. A camshaft adjuster comprising:
a drive element;
an output element; and
a spring,
the drive element and the output element being rotatable relative to each other, the spring being fixed by a drive element spring bearing of the drive element and an output element spring bearing of the output element, the spring supporting the relative rotation between the drive element and the output element, a radius of curvature R1 of the spring being smaller than a radius of curvature R2 of at least one of the drive element and output element spring bearings, a two-line contact between the spring and the one of the drive element and output element spring bearings being formed due to the different radii of curvatures R1 and R2.

2. The camshaft adjuster as recited in claim 1 wherein the spring has a coil body having coils extending in a radial direction.

3. The camshaft adjuster as recited in claim 1 wherein the drive element spring bearing or the output element spring bearing is designed as a pin.

4. The camshaft adjuster as recited in claim 1 wherein the drive element spring bearing supports one end of the spring and the output element spring bearing supports the other end of the spring.

5. The camshaft adjuster as recited in claim 1 wherein the spring has a coil body and at least one the drive element spring bearing and the output element spring bearing supports the coil body of the spring.

6. The camshaft adjuster as recited in claim 1 wherein all of the drive element and output element spring bearings have the two-line contact formed by the radii of curvature R1 and R2.

7. The camshaft adjuster as recited in claim 1 wherein at least one of the output element spring bearing and the drive element spring bearing is coated with a wear-resistant coating.

8. The camshaft adjuster as recited in claim 1 wherein a coil body of the spring has a larger radius of curvature R3 between the output element and drive element spring bearings than the radius R2 of at least one of the output element or drive element spring bearings forming the two-line contact.

9. A camshaft adjuster comprising:

a drive element;

an output element; and a spring, the drive element and the output element being rotatable relative to each other, the spring being fixed by a drive element spring bearing of the drive element and an output element spring bearing of the output element, the spring supporting the relative rotation between the drive element and the output element, a radius of curvature R1 of the spring being smaller than a radius of curvature R2 of each of the drive element and output element spring bearings, a two-line contact between the spring and the one of the drive element and output element spring bearings being formed due to the different radii of curvatures R1 and R2.

10. The camshaft adjuster as recited in claim 9 wherein the spring has a coil body having coils extending in a radial direction.

11. The camshaft adjuster as recited in claim 9 wherein the drive element spring bearing or the output element spring bearing is designed as a pin.

12. The camshaft adjuster as recited in claim 9 wherein the drive element spring bearing supports one end of the spring and the output element spring bearing supports the other end of the spring.

13. The camshaft adjuster as recited in claim 9 wherein the spring has a coil body and at least one the drive element spring bearing and the output element spring bearing supports the coil body of the spring.

14. The camshaft adjuster as recited in claim 9 wherein all of the drive element and output element spring bearings have the two-line contact formed by the radii of curvature R1 and R2.

15. The camshaft adjuster as recited in claim 9 wherein at least one of the output element spring bearing and the drive element spring bearing is coated with a wear-resistant coating.

16. The camshaft adjuster as recited in claim 9 wherein a coil body of the spring has a larger radius of curvature R3 between the output element and drive element spring bearings than the radius R2 of at least one of the output element or drive element spring bearings forming the two-line contact.

* * * * *